US005172992A

United States Patent [19]

Ackermann

[11] Patent Number: 5,172,992

[45] Date of Patent: Dec. 22, 1992

[54] MASCARA CONTAINER WITH STIRRER

[75] Inventor: Walter T. Ackermann, Watertown, Conn.

[73] Assignee: Risdon Corporation, Naugatuck, Conn.

[21] Appl. No.: 848,322

[22] Filed: Mar. 9, 1992

[51] Int. Cl.[5] ..... A45D 40/00

[52] U.S. Cl. ..... 401/4; 401/129

[58] Field of Search ..... 401/4, 126, 129, 118; 132/130

[56] References Cited

U.S. PATENT DOCUMENTS

| | | | |
|---|---|---|---|
| 2,793,012 | 5/1957 | Wolf | 401/129 X |
| 2,990,834 | 7/1961 | Amen . | |
| 3,204,283 | 9/1965 | Damron | 401/4 |
| 3,209,387 | 10/1965 | Lukesch | 401/4 |
| 3,311,941 | 4/1967 | Buchwalter et al. | 401/4 |
| 3,336,624 | 8/1967 | Schefer et al. | 401/4 |
| 3,456,923 | 7/1969 | Zeuzem | 401/4 X |
| 3,606,276 | 9/1971 | Jackson . | |
| 4,290,706 | 9/1981 | Wandl . | |
| 4,960,339 | 10/1990 | Iizuka et al. . | |
| 4,984,918 | 1/1991 | Iizuka et al. . | |

FOREIGN PATENT DOCUMENTS

| | | | |
|---|---|---|---|
| 1189683 | 12/1961 | France | 401/4 |

*Primary Examiner*—Danton D. DeMille
*Attorney, Agent, or Firm*—Dallett Hoopes

[57] ABSTRACT

A mascara container is provided with a stirrer comprising an oblong frame having side elements spaced inward from the container wall. The spacing permits working of the fluid adjacent the stirrer blades against the stationary fluid adhering to the wall of the container, such working and related shear makes the fluid less viscous so that it flows downward in the container.

5 Claims, 1 Drawing Sheet

MASCARA CONTAINER WITH STIRRER

BACKGROUND OF THE INVENTION

1. Field of the Invention

This invention relates to a mascara container which is provided with a stirrer device. More specifically, the invention provides means for driving the stirrer automatically as the container cap is screwed on or off.

2. Description of Related Art including Information Disclosed under §1.97 to 1.99

The prior art is replete with mascara containers. An example is the recent U.S. Pat. No. 4,984,918 to Iizuka et al which issued Jan. 15, 1991. In this patent a wiper is provided in the form of a spiral frame suspended from a hub in the opening of the container, the frame having elements which engage the inside wall of the mascara container. Means are provided by which the applicator drives the wiper around as the cap is rotated. Iizuka et al is especially concerned with wiping the inside wall and moving the mascara material clinging to the wall in a downward direction.

Other patents in the prior art feature containers having stirring means, some of which are engaged by the cap or applicator so that as the cap rotates, the stirrer does also. Patents such as U.S. Pat. No. 2,793,012 to W. P. Wolf issued May 21, 1957 and U.S. Pat. No. 3,456,923 which issued Jul. 22, 1969 to R. M. Zeuzem are pertinent to this concept.

The art does not include, however, the idea of a mascara container having cylindrical walls and provided with an oblong stirrer having rectangular shape with parallel stirring elements or blades spaced inward from the wall of the container.

SUMMARY OF THE INVENTION

The present invention, therefore, is a mascara container having in its neck a hub with an opening therethrough and a stirrer extending downward from the hub. The stirrer is an oblong frame and has parallel side elements spaced inward from the wall of the container. A cap is provided having a central depending applicator. In use, when the cap is screwed on or screwed off the container, the applicator keys into the opening in the hub to automatically turn the stirrer to agitate and work the fluid.

A special feature of the invention is that the side elements of the stirrer do not engage the side wall of the container. The stirrer is not a wiper, but is an agitator which, being spaced from the wall of the container, permits fluid to be stationary and adhere to the container wall. The stirrer agitates and works mascara fluid spaced from the wall, working it against the stationary fluid and working it with the blade of the agitator itself. As a result, as will be described below, the fluid becomes less viscous and moves downward to the bottom of the container.

Another feature of the invention is that in use the stirrer flexes, its lower end being retained by the drag of the heavy, thick mascara fluid. This twists the frame of the stirrer so that the leading edges of the side elements or blades angle downward and give a downward movement component to the particles of fluid they engage. This is important because the applicator, when being withdrawn, lifts fluid upward and the stirrer, as described above, moves it back downward where it is more apt to engage the applicator brush.

BRIEF DESCRIPTION OF THE DRAWINGS

Further objects and features of the invention will be apparent from the following specification and the drawings, all of which disclose a non-limiting embodiment of the invention. In the drawings.

DESCRIPTION OF THE PREFERRED EMBODIMENT

Figure 1:
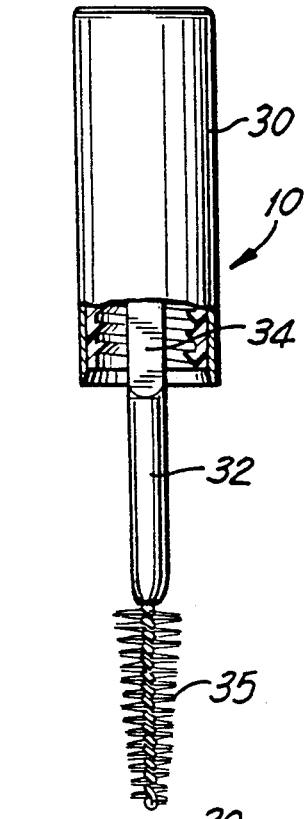
FIG. 1 is an exploded view showing the mascara container with the cap and applicator removed.
Figure 1:
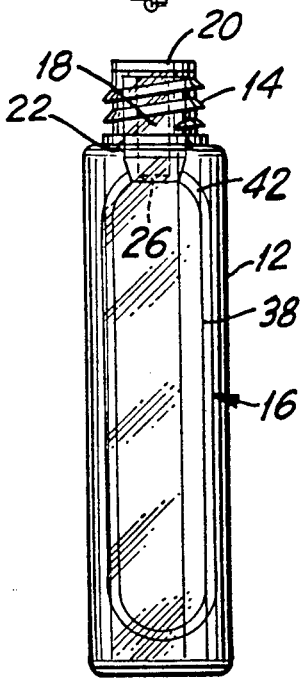
Figure 5:
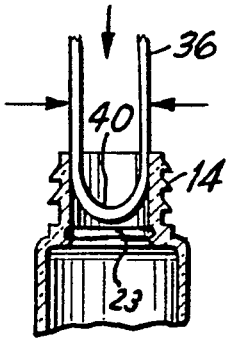
FIG. 5 is a fragmentary view showing the lower end of the stirrer being inserted into the container in assembly.

A mascara container embodying the invention is generally designated 10 in FIG. 1. It comprises a cylindrical container 12 having an externally threaded neck 14. A stirrer 16 comprises a cylindrical hub 18 which rotatably fits within the neck. The upper end of the hub has a retaining flange 20 which butts against the top of the neck and a retaining nib or detent 22 which fits into an annular groove 23 (FIG. 5) on the inside of the bottle neck 14 and releasably holds the stirrer inside the container. The hub is formed with an opening 24 (FIG. 2) therethrough which preferably is square-shaped. At its lower end the opening is reduced to provide a wiping edge 26 for wiping excess off the applicator.

A stylized cap 30 is provided which is internally threaded as shown to mate with the threads on the neck 14. An applicator 32 extends down centrally along the axis of the cap and is square-shaped at its upper end as at 34. The lower end of the applicator comprises the conventional mascara brush 35.

Figure 2:
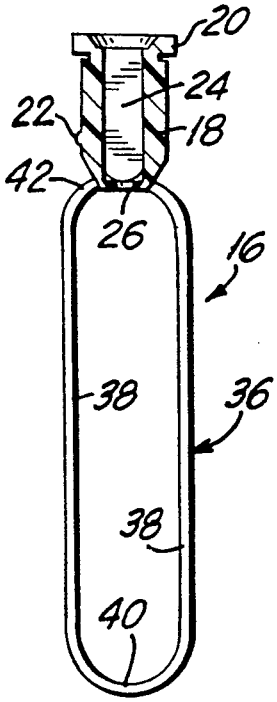
FIG. 2 is a slightly enlarged side elevational view of the stirrer, the hub being shown in section.
Figure 3:
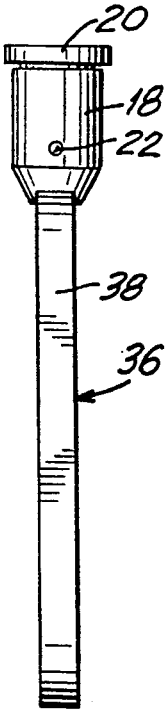
FIG. 3 is a front elevational view.
Figure 4:
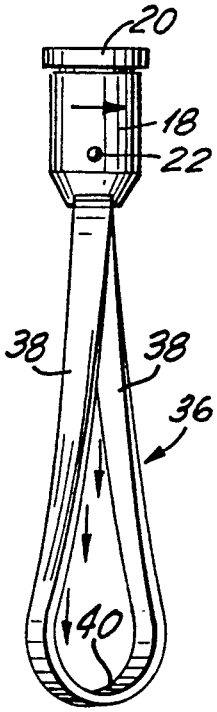
FIG. 4 is a front elevational view of the stirrer as it would appear when the hub is rotated and the lower end of the stirrer is held back by the viscous fluid.

As shown in FIGS. 2 through 4, the stirrer 16, aside from the hub 18, comprises an open frame 36 which has parallel sides 38 and semi-circular ends 40 and 42. The end 42 is attached to the lower end of the hub 18 so that when the hub is rotated about its axis, the frame 36 also rotates. Preferably the sides 38 and the ends 40, 42 of the frame are uniformly rectangular in crosssection.

The stirrer is molded of one piece of plastic which may be polypropylene, polyethylene, nylon or acetal resin, for instance, and the dimensions of the parts of the frame are such that the frame may flex; that is, the side walls may be squeezed together or the frame may be axially twisted. For example, in FIG. 3 the frame may have a flat appearance, while in FIG. 4, as when the hub is rotated while the frame is immersed in the thick mascara fluid, the frame may twist.

Thus, in installation of the stirrer into the container 12, (FIG. 5) the end 40 of the frame and the sides may be squeezed together to enter the neck 14 of the container. When the stirrer is fully installed, the frame will return to its original molded shape. During the installation, the retaining nib 22 will be compressed as the hub 18 slides into the neck 14. When it is fully installed, the nib 22 will return to its protruding shape to retain the stirrer in the container.

When the applicator is being installed in the container, the brush 35 is inserted into the opening 24 in hub 18 and through the wiper 26. As the threads on the neck 14 begin to engage the threads on the inside of the cap 30, the square upper end 34 of the applicator 32 keys into the square opening 24 in the stirrer causing the stirrer 16 to rotate with the turning cap as it is screwed on.

An essential feature of the invention is that the stirrer 16 is dimensioned so that its sides 38 do not contact the inside of the side wall of the container 12. The sides of the frame, rather, are parallel to the wall and spaced inward slightly therefrom. This dimension can be readily controlled, of course, by the shape of the mold cavity for the stirrer.

Figure 6:
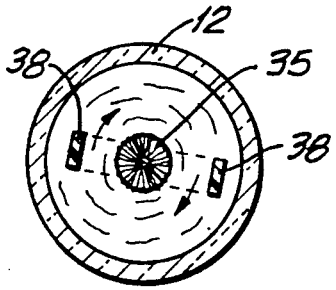
FIG. 6 is a slightly enlarged sectional view taken halfway down the container in a plane perpendicular to the axis of the container.
Figure 7:
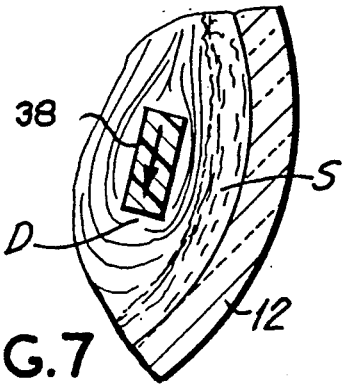
FIG. 7 is a fragmentary sectional view through a side wall and side element of the stirrer and showing the action of the stirrer on the fluid in the container.

As shown in FIG. 6, and explained above, the frame rotates as the cap is screwed on, the side elements traveling in a circular path spaced inward from the side wall of the container 12. The importance of the spacing inward from the side wall will be understood upon reference to FIG. 7 wherein the mascara fluid S adjacent the wall 12 is stationary while the fluid D in the path of the frame will be cut through or sliced through by the stirrer. The action shown tends to agitate and work the mascara fluid better than a simple wiper which would be right up against the wall and wipe the fluid adjacent the container wall away from the wall and merely rotate the mass of mascara fluid around as the stirrer is rotated.

Instead of that, under the present invention the fluid S against the wall is a stationary layer (FIG. 7) and the stirrer element 38 slices through it in a path spaced inward from the wall so that there is a shear action as the fluid D is worked by the side element 38 of the stirrer. After the side element 38 is past, it leaves the fluid in a worked condition which makes the fluid adjacent the path of the side element thinner so that it flows better and ends up toward the bottom of the container 12. The reason why the fluid becomes thinner due to the working by the side elements of the frame is that shear inflicted on the fluid by the moving side element tends to orient the molecules in the fluid so that they extend generally in one direction and, hence, flow is facilitated and viscosity is reduced.

The twisting of the frame 36 (FIG. 4) causes an angling of the side elements so that the leading edges thereof slant down toward the lower end of the container and give a downward movement component to the portions of the fluid they engage. This is shown graphically in FIG. 4 wherein arrows indicate the downward direction of particles of mascara. It may be desirable to slightly thin the upper ends of the side elements 38 to give the twisting of the open frame greater slanting of the side elements and hence, a greater downward component to the movement of the particles.

Similarly, the form of the stirrer may be varied. Its side elements may be formed with grooves or vanes to enhance the stirring. Thus, the invention is not limited to the embodiment shown but the invention is instead defined by the scope of the following claim language, expanded by an extension of the right to exclude as is appropriate under the doctrine of equivalents.

What is claimed is:

1. A mascara container having a cylindrical body comprising a side wall and a circular bottom end wall and an externally threaded reduced neck at the upper end, a stirrer for said container comprising a molded plastic hub rotatably secured in the neck and a collapsible agitator within the container and secured to and integrally molded with the hub, the agitator being in the form of an oblong open frame of uniform cross-section and having straight parallel side elements, and semi-circular ends, the side elements being proximate but spaced from the side wall of the cylindrical container and the semi-circular end remote from the hub being spaced above the bottom wall, the hub having an opening therethrough, and an internally threaded cap for the container and an elongate mascara applier secured to and extending axially from the cap, the end of the applier proximate the cap being keyed for rotation with the hub.

2. A container as claimed in claim 1 wherein the sides and ends of the agitator are rectangular in cross-section and the ends of the frame are semi-circular.

3. A container as claimed in claim 1 wherein the hub and frame are a unitary molded structure.

4. A container as claimed in claim 1 wherein the hub has a cylindrical outer surface with an outward retainer flange on the outer end thereof resting against the outer end of the neck and a detent on eh side of the hub spaced from the flange and engaging in an annular groove about the inside of the bottle neck.

5. A container as claimed in claim 1 wherein the frame of the agitator flexes as the stirrer is turned and the agitator works against the contents of the container, angling the side elements with respect to the axis of the container to move the contents toward the bottom of the container.

* * * * *